US009193941B2

(12) United States Patent
Batchelor et al.

(10) Patent No.: US 9,193,941 B2
(45) Date of Patent: Nov. 24, 2015

(54) BRIGHT DETERGENT COMPOSITION

(71) Applicant: Conopco, Inc., Englewood Cliffs, NJ (US)

(72) Inventors: Stephen Norman Batchelor, Chester (GB); Jayne Michelle Bird, Ellesmere Port (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 14/413,750

(22) PCT Filed: Jul. 16, 2013

(86) PCT No.: PCT/EP2013/064985
§ 371 (c)(1),
(2) Date: Jan. 9, 2015

(87) PCT Pub. No.: WO2014/012921
PCT Pub. Date: Jan. 23, 2014

(65) Prior Publication Data

US 2015/0141317 A1 May 21, 2015

(30) Foreign Application Priority Data

Jul. 17, 2012 (EP) ..... 12176666

(51) Int. Cl.

| | |
|---|---|
| ***C11D 1/02*** | (2006.01) |
| ***C11D 1/66*** | (2006.01) |
| ***C11D 3/40*** | (2006.01) |
| ***C11D 3/42*** | (2006.01) |
| ***C11D 1/83*** | (2006.01) |
| ***C11D 3/18*** | (2006.01) |
| ***C11D 3/34*** | (2006.01) |

(52) U.S. Cl.
CPC .. *C11D 3/40* (2013.01); *C11D 1/02* (2013.01); *C11D 1/66* (2013.01); *C11D 1/83* (2013.01); *C11D 3/187* (2013.01); *C11D 3/349* (2013.01); *C11D 3/42* (2013.01)

(58) Field of Classification Search
CPC ..... C11D 1/02; C11D 1/66; C11D 3/40; C11D 3/42
See application file for complete search history.

(56) References Cited

FOREIGN PATENT DOCUMENTS

WO WO 2011/011799 * 1/2011 ..... C11D 3/40
WO WO2011011799 1/2011

OTHER PUBLICATIONS

Tariq et al., "Heterogeneous photocatalytic degradation of an anthraquinone and a triphenylmenthane dye derivative in aqueous suspensions of semiconductor"; Dyes and Pigments, Nov. 14, 2006, vol. 76, pp. 358-365; XP002689812 (pp. 1-8).
Chen et al., The effect of sodium hydroxide in photolytic and photocatalytic degradation of Acid Blue 29 and Ethyl Violet, Dyes and Pigments, Dec. 1, 2005, vol. 73, pp. 55-58; XP002689811 (pp. 9-12).
IPRP2 in PCTEP2013064985 dated May 6, 2014, (pp. 13-26).
IPRP2 in PCTEP2013064989 dated Oct. 29, 2014, (pp. 27-53).
Saquib et al., "Photocatalytic degradation of two selected dye derivatives in aqueous suspensions of titanium dioxide", Desalination, 2008, vol. 219, pp. 301-311; XP002689814, (pp. 54-64).
Search Report in EP12176664 dated Jan. 8, 2013, (pp. 65-67).
Search Report in EP12176666 dated Jan. 8, 2013, (pp. 68-70).
Search Report in PCTEP2013064985 dated Oct. 25, 2013, (pp. 71-74).
Search Report in PCTEP2013064989 dated Oct. 25, 2013, (pp. 75-78).
Sokolova et al., "Photostabilization of Xanthene, Triarylmethane, and Azine Dyes in Polymeric Matrix", Russian Journal of Applied Chemistry, 2011, vol. 84, pp. 670-675; XP002689813 (pp. 79-84).
Written Opinion in EP12176664 dated Jan. 8, 2013, (pp. 85-88).
Written Opinion in EP12176666 dated Jan. 8, 2013, (p. 89-92).
Written Opinion in PCTEP2013064985 dated Oct. 25, 2013, (pp. 93-96).
Written Opinion in PCTEP2013064989 dated Oct. 25, 2013, (pp. 97-104).
Co-pending Application: Applicant: Batchelor et al., Filed: Jan. 9, 2015.

* cited by examiner

*Primary Examiner* — Brian P Mruk
(74) *Attorney, Agent, or Firm* — Greenberg Traurig, LLP

(57) ABSTRACT

A colored laundry detergent is provided that brightens on exposure to light.

14 Claims, No Drawings

BRIGHT DETERGENT COMPOSITION

FIELD OF INVENTION

The invention concerns detergent formulations with dyes.

BACKGROUND OF THE INVENTION

WO2011/011799 (Procter and Gamble) discloses violet thiophene dyes containing a cationic group covalently bound to alkoxy groups for use in laundry detergents for whitening textiles.

To obtain other aesthetic colours in the detergent, violet cationic thiophene dyes are mixed with additional dyes. Colour brightness is a key attribute of colour that the consumer desires. Consumers do not like dull colours.

SUMMARY OF THE INVENTION

We have found that mixtures of violet thiophene dyes and blue triphenyl methane, phenazine or anthraquinone dyes become brighter blue on exposure to sunlight.

In one aspect the present invention provides a detergent composition comprising:

(i) from 0.0001 to 0.1 wt %, preferably from 0.0005 to 0.005 wt %, of a violet cationic alkoxylated thiophene dye comprising an cationic group covalently bound to alkoxy groups;

(ii) a blue dye selected from the chromophore classes: anthraquinone; triphenyl methane; and phenazine chromophores, wherein the molar ratio of blue dye to violet cationic alkoxylated thiophene dye is in the range from 15:1 to 1:15; and, (iii) from 5 to 70 wt % of surfactants selected from anionic and non-ionic surfactants.

The detergent composition may be in any solid physical form, preferably granular or liquid, most preferably a liquid detergent composition. The liquid detergent compositions are preferably isotropic.

DETAILED DESCRIPTION OF THE INVENTION

Surfactant

In general, the surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981. Preferably the surfactants used are saturated.

Preferably the composition comprises between 5 to 70 wt % of surfactants selected from anionic and non-ionic surfactants, most preferably 10 to 30 wt %.

The fraction of non-ionic surfactant is preferably from 0.05 to 0.75 of the total wt % of the anionic and non-ionic surfactant, preferably from 0.1 to 0.6, more preferably from 0.3 to 0.6, most preferably from 0.45 to 0.55.

Non-ionic

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Preferred nonionic detergent compounds are $C_6$ to $C_{22}$ alkyl phenol-ethylene oxide condensates, generally 5 to 9 EO, i.e. 5 to 9 units of ethylene oxide per molecule, and the condensation products of aliphatic $C_8$ to $C_{18}$ primary or secondary linear or branched alcohols with ethylene oxide, with 5 to 9 EO.

The non-ionic surfactant preferably contains an alkyl alkoxylate. The alkyl alkoxylate is preferably and alkyl ethoxylate, with formula $R^1(OCH_2CH_2)_pOH$:

where $R^1$ is an alkyl group that may be primary or secondary and contains C10-C16 carbon atoms. Most preferably $R^1$ is a C12-C15 primary alkyl chain.

p is from 5 to 9, preferably from 7 to 9.

The preferred alkyl alkoxylate is preferably greater than 50% of all the non-ionic present, more preferably greater than 70%, most preferably greater than 90%.

1) Anionic Surfactants

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from palm kernel, tallow or coconut oil, methyl ester sulphonates, and synthetic alcohols derived from petroleum. Most preferred anionic surfactants are sodium lauryl ether sulfate (SLES), particularly preferred with 1 to 3 ethoxy groups, sodium $C_{10}$ to $C_{15}$ alkyl benzene sulphonates and sodium $C_{12}$ to $C_{18}$ alkyl sulphates. The chains of the surfactants may be branched or linear.

Soaps are also preferred. The fatty acid soap used preferably contains from about 16 to about 22 carbon atoms, preferably in a straight chain configuration. The anionic contribution from soap is preferably from 0 to 30 wt % of the total anionic.

Preferably, at least 50 wt % of the anionic surfactant are selected from: sodium $C_{11}$ to $C_{15}$ alkyl benzene sulphonates; and, sodium $C_{12}$ to $C_{18}$ alkyl sulphates. Even more preferably, the anionic surfactant is sodium $C_{11}$ to $C_{15}$ alkyl benzene sulphonates.

Violet Thiophene Dye

The cationic alkoxylated thiophene dye is violet in colour in aqueous solution. In aqueous solution, they preferably have an optical absorption maximum in the visible of 550 to 590 nm, more preferably 560 to 580 nm. This is measured using a UV-VIS spectrometer in aqueous solution.

The dye has a maximum molar extinction coefficient at a wavelength in the range 400 to 700 nm of at least 30 000 $mol^{-1}$ L $cm^{-1}$, preferably greater than 50000 $mol^{-1}$ L $cm^{-1}$.

The cationic alkoxylated thiophene dyes are preferably of the following generic form: Dye-$NR_1R_2$. The $NR_1R_2$ group is attached to an aromatic ring of the dye.

Where at least one of $R_1$ and $R_2$ are independently selected from polyoxyalkylene chains having 2 or more repeating units and preferably having 2 to 12 repeating units, wherein the polyalkylene chain is terminated by cationic group. Examples of polyoxyalkylene chains include ethylene oxide, propylene oxide, glycidol oxide, butylene oxide and mixtures thereof.

The dye is preferably of the form:

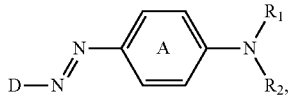

where D is a thiophene group and the A group may be substituted by further uncharged organic groups. Preferred uncharged organic groups are $NHCOCH_3$, methyl, ethyl, methoxy and ethoxy.

Preferably the polyoxyalkylene chains are polyethoxylates with preferably 2 to 7 ethoxylates.

The cationic alkoxylated thiophene dye is preferably a mono-azo dye.

Preferably the only charged species on the dye is a quaternary aliphatic or aromatic ammonium group; most preferably a quaternary aliphatic ammonium group.

Preferred examples of the dye are:

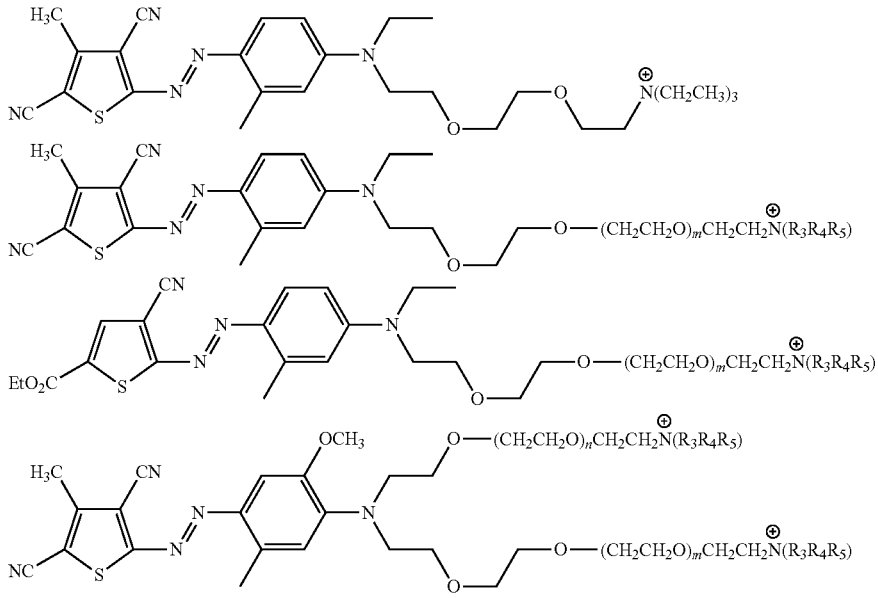

Most preferably the dye is of the form:

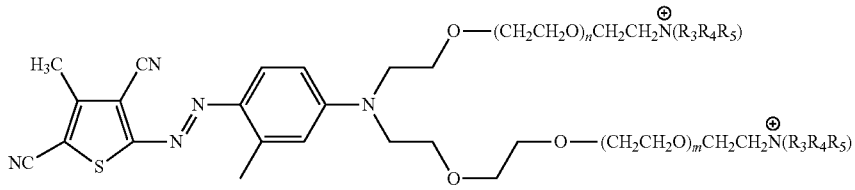

Where n is from 0, 1, 2, 3, 4, 5, 6 or 7 and Where m is from 0, 1, 2, 3, 4, 5, 6 or 7 $R_3$, $R_4R_5$ are selected from alkyl and substituted alkyl, preferably —$CH_3$; —$C_2H_5$; —$C_2H_4OH$; —$C_2H_4CN$, most preferably —$CH_3$; and —$C_2H_5$.

Further examples of the dye include:

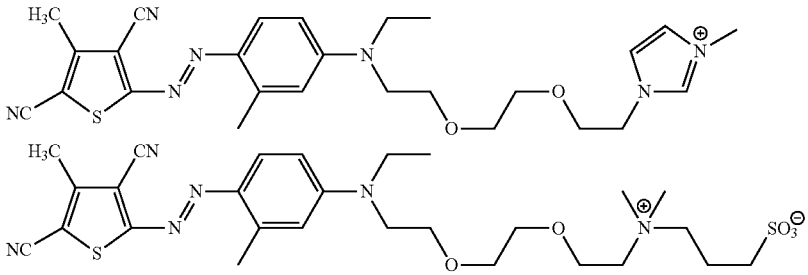

Blue Dye

The Blue dye is selected from the anthraquinone, triphenyl methane and phenazine chromophores, more preferably triphenylmethane and anthraquinone, most preferably triphenylmethane chromophores.

The blue dye is blue in colour in aqueous solution. Blue includes green-blue. In aqueous solution, the blue dye preferably has an optical absorption maximum in the visible of 590 to 660 nm, more preferably 600 to 650 nm. This is measured using a UV-VIS spectrometer.

Many such dyes are listed under Acid Blue dyes in the Colour Index (Society of Dyers and Colourists and American Association of Textile Chemists and Colorists).

The molar ratio of blue dye to violet thiophene dye is preferably in the range 15:1 to 1:15. For triphenyl methane dyes the molar ratio of blue dye to violet thiophene dye is preferably in the range 10:1 to 1:10, more preferably 1:1 to 1:3. For anthraquinone blue dyes is preferably in the range 10:1 to 1:1, more preferably 5:1 to 2:1. For phenazine blue dyes is preferably in the range 10:1 to 1:10, more preferably 2:1 to 1:2.

Preferably the blue dye is sulphonated and/or bears (growls) a poly(alkoxy) chain. Most preferably the dye is sulphonated.

Preferred triphenyl methane dyes contain 2 amine groups, which are bound to separate aromatic rings of the dye. Preferred triphenylmethane dyes are Acid Blue 1, Acid Blue 3; Acid Blue 5, Acid Blue 7, Acid Blue 9, Acid Blue 11, Acid Blue 13, Acid Blue 15, Acid Blue 17, Acid Blue 24, Acid Blue 34, Acid Blue 38, Acid Blue 75, Acid Blue 83, Acid Blue 91, Acid Blue 97, Acid Blue 93, Acid Blue 93:1, Acid Blue 97, Acid Blue 100, Acid Blue 103, Acid Blue 104, Acid Blue 108, Acid Blue 109, Acid Blue 110, and Acid Blue 213.

Preferred anthraquinone dyes are Acid Blue 25, Acid Blue 23, Acid Blue 27, Acid Blue 43, Acid Blue 45, Acid Blue 80, Acid Blue 49, Acid Blue 69, Acid Blue 124, Acid Blue 129, Acid Blue 129:1, and Acid Blue 145.

Preferred phenazine dyes are Acid Blue 59, Acid Blue 98, Acid Blue 61, Acid Blue 61:1, Acid Blue 102.

EXPERIMENTAL

Example 1

Detergent solutions were created containing 7.28 wt % anionic surfactant and 7.28 wt % non-ionic surfactant. The anionic surfactant was linear alkyl benzene sulfonate. The non-ionic was a from primary alkyl ethoxylate with a primary C12-C15 alkyl group and 7 moles of ethoxylate per 1 mole of alkyl group and 0.001 wt % of the cationic thiophene dye:

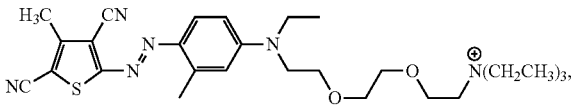

was added to the formulations, such that the optical density (1 cm) at the maximum absorption in the range 400-700 nm was ~1. The solution was violet in colour. The sample was split into 4 aliquots, blue dyes added at a level, such that if added to detergent solution alone without the violet dye they would have an optical density at the max of ~1. The UV-VIS spectra of the formulations were measure in a 1 cm plastic cuvette. The solutions were blue in colour.

The value of the optical density at the maximum absorption of the detergent in the visible (400-700 nm) was measured, OD (max) and also the value at 450 nm, OD (450). The fraction Brightness=OD(max)/OD(450) provides a measure of the brightness of the solution, the larger the fraction the brighter the solution. OD(max) is a measure of the desired colour and OD(450) a measure of the undesired (dulling colour).

The formulations in the plastic cuvettes were irradiated in a weatherometer for 30 minutes with simulated sunlight (385 $W/m^2$ 300-800 nm). The UV-VIS spectra were then recorded again.

The change in brightness was calculated according the following formula:

$$\text{Brightness}=\text{Brightness (final)}-\text{Brightness (initial)}.$$

A positive value indicates an increase in Brightness.

The experiments were repeated 4 times. And the results summarised in the table below.

| Blue dye chromophore | Blue dye | ● Brightness | 95% confidence limits |
|---|---|---|---|
| Azo (reference) | Acid Blue 29 | −0.06 | 0.07 |
| Anthraquinone | Acid Blue 80 | 1.09 | 0.24 |
| Phenazine | Acid Blue 59 | 0.59 | 0.06 |
| Triphenylmethane | Acid Blue 1 | 1.58 | 0.05 |

The Anthraquinone, triphenylmethane and phenazine dye increase in brightness on irradiation. The azo dye does not.

Example 2

Photostability of the Blue Dyes

Detergent solutions were created containing 7.28 wt % anionic surfactant and 7.28 wt % non-ionic surfactant. The anionic surfactant was linear alkyl benzene sulfonate. The non-ionic was a primary alkyl ethoxylate with a primary C12-C15 alkyl group and 7 moles of ethoxylate per 1 mole of alkyl group. Blue dye was added at level such that the optical density (1 cm) at the maximum absorption of the blue dye was ~1.

The UV-VIS spectra of the formulations were measure in a 1 cm plastic cuvette. The solutions were blue in colour.

The value of the optical density at the maximum absorption of the detergent in the visible (400-700 nm) was measured, OD (max). The formulations in the plastic cuvettes were irradiated in a weatherometer for 30 minutes with simulated sunlight (385 $W/m^2$ 300-800 nm). The UV-VIS spectra were then recorded again. The percentage of blue dye lost (% dye lost) due to photoirradation was calculate using the equation:

$$\%\ \text{dye lost}=100\times(1-OD(\text{after irradiation})/OD(\text{before irradiation}))$$

The experiment was repeated four times for each of the blue dyes of example 1.

The results are given in the table below:

| Blue dye chromophore | Blue dye | % dye lost | 95% confidence limits |
|---|---|---|---|
| Azo (reference) | Acid Blue 29 | 61.3 | 4.1 |
| Anthraquinone | Acid Blue 80 | 10.0 | 0.8 |
| Phenazine | Acid Blue 59 | 42.8 | 1.7 |
| Triphenylmethane | Acid Blue 1 | 79.0 | 6.5 |

No correlation exists between the photostability of the blue dyes alone and the increase brightness observed in example 1.

Acid Blue 1 is the least photostable of the dyes yet provides the greatest increase in brightness. Acid Blue 29 has the second lowest photostability yet provides no increase in brightness. Acid blue 59 and Acid Blue 80 are the most photostable yet provide an increase in brightness.

We claim:

1. A detergent composition comprising:

(i) from 0.0001 to 0.1 wt % of a violet cationic alkoxylated thiophene dye comprising a cationic group covalently bound to alkoxy groups;

(ii) a blue dye selected from the chromophore classes: anthraquinone; triphenyl methane; and phenazine chromophores, wherein the molar ratio of blue dye to violet cationic alkoxylated thiophene dye is in the range from 15:1 to 1:15; and, (iii) from 5 to 70 wt % of surfactants selected from anionic and non-ionic surfactants.

2. A detergent composition according to claim 1, wherein the blue dye is a triphenylmethane chromophore.

3. A detergent composition according to claim 1, wherein the detergent composition is a liquid detergent composition.

4. A detergent composition according to claim 1, wherein the violet cationic alkoxylated thiophene dye is of the form:

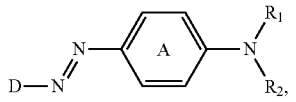

wherein D is a thiophene group each of $R_1$ and $R_2$ is selected from the group consisting of ethyl and polyoxyalkylene chains having 2 or more repeating units and wherein at least one of the polyoxyalkylene chains of $R_1$ or $R_2$ is terminated by a cationic group, with the proviso that and at least one of $R_1$ and $R_2$ contains polyoxyalkylene chains having 2 or more repeating units and wherein at least one of the polyoxyalkylene chains of $R_1$ or $R_2$ is terminated by cationic group.

5. A detergent composition according to claim 4, wherein the polyoxyalkylene chains have 2 to 12 repeating units.

6. A detergent composition according to claim 5, wherein the polyoxyalkylene chains have 2 to 7 repeating units.

7. A detergent composition according to claim 4, wherein polyoxyalkylene units are ethoxylates.

8. A detergent composition according to claim 1, wherein the only charged species on the violet cationic alkoxylated thiophene dye is a quaternary aliphatic or aromatic ammonium group.

9. A detergent composition according to claim 8, wherein the only charged species on the violet cationic alkoxylated thiophene dye is a quaternary aliphatic ammonium group.

10. A detergent composition according to claim 4, wherein ring A is substituted by a group selected from: $NHCOCH_3$, methyl, ethyl, methoxy and ethoxy.

11. A detergent composition according to claim 4, wherein the violet cationic alkoxylated thiophene dye is selected from:

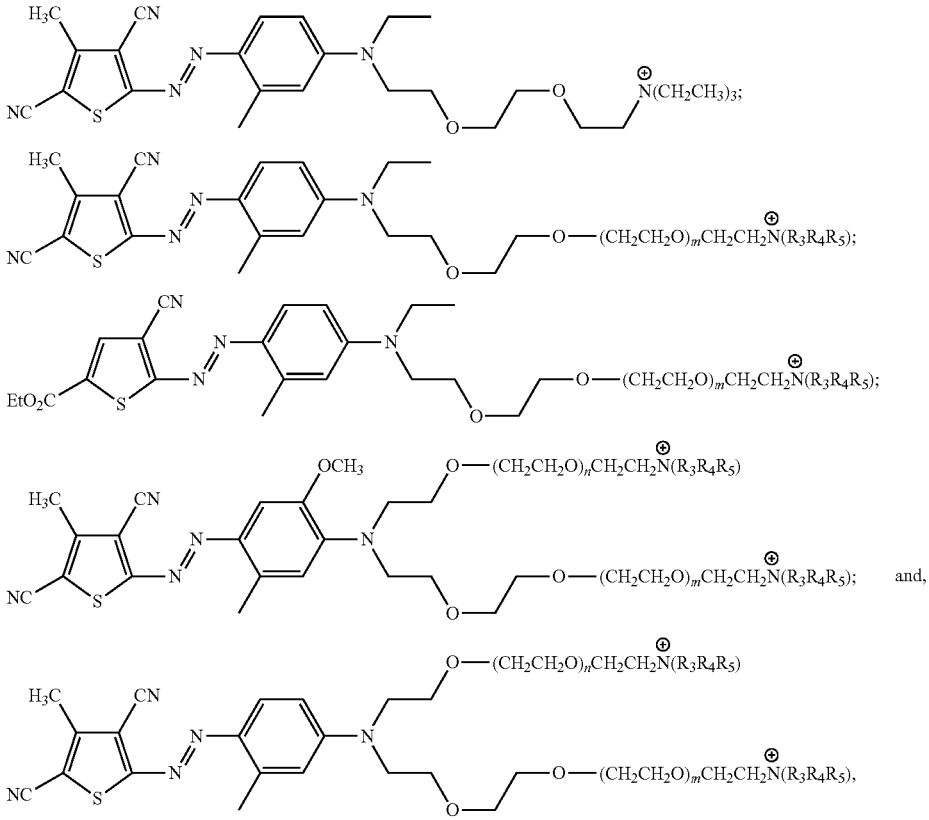

wherein n is selected from: 0; 1; 2; 3; 4; 5; 6; and 7,and m is selected from: 0; 1; 2; 3; 4; 5; 6; and 7,and $R_3$, $R_4$, and $R_5$ are selected from: alkyl; and substituted alkyl.

12. A detergent composition according to claim 11, wherein the alkyl and substituted alkyl are selected from: —$CH_3$; —$C_2H_5$; —$C_2H_4OH$; and —$C_2H_4CN$.

13. A detergent composition according to claim 1, wherein the blue dye is covalently bound to a group selected from sulphonated and a polyalkoxy chain.

14. A detergent composition according claim 13, wherein the blue dye is selected from: Acid Blue 1; Acid Blue 3; Acid Blue 5; Acid Blue 7; Acid Blue 9; Acid Blue 11; Acid Blue 13; Acid Blue 15; Acid Blue 17; Acid Blue 24; Acid Blue 34; Acid Blue 38; Acid Blue 75; Acid Blue 83; Acid Blue 91; Acid Blue 97; Acid Blue 93; Acid Blue 93:1; Acid Blue 97; Acid Blue 100; Acid Blue 103; Acid Blue 104; Acid Blue 108; Acid Blue 109; Acid Blue 110; and Acid Blue 213.

* * * * *